United States Patent [19]

Bell

[11] 4,257,232

[45] Mar. 24, 1981

[54] CALCIUM CARBIDE POWER SYSTEM

[76] Inventor: Ealious D. Bell, 523 Palmwood Ct., San Diego, Calif. 92159

[21] Appl. No.: 57,438

[22] Filed: Jul. 13, 1979

Related U.S. Application Data

[63] Continuation of Ser. No. 745,179, Nov. 26, 1976, abandoned.

[51] Int. Cl.[3] ..... F01K 13/00

[52] U.S. Cl. ..... 60/676; 60/648; 48/216; 126/263

[58] Field of Search ..... 60/643, 645, 648–650, 60/670–671, 673, 676, 682, 665, 667; 48/38, 59, 216; 423/439, 441; 126/263; 106/43

[56] References Cited

U.S. PATENT DOCUMENTS

| | | | |
|---|---|---|---|
| 2,357,186 | 8/1944 | Gfeller | 48/216 |
| 2,951,748 | 9/1960 | Murphy et al. | 48/216 |
| 3,498,767 | 3/1970 | Foster | 48/216 |
| 3,545,207 | 12/1970 | Barber et al. | 60/664 X |
| 3,664,134 | 5/1972 | Seitz | 48/38 X |
| 3,975,913 | 8/1976 | Erickson | 60/648 X |

*Primary Examiner*—Allen M. Ostrager
*Assistant Examiner*—Stephen F. Husar
*Attorney, Agent, or Firm*—Blakely, Sokoloff, Taylor & Zafman

[57] ABSTRACT

A calcium carbide based power system for stationary and mobile power plants. The carbide is reacted with water to create heat and acetylene, with the acetylene then being burned to heat a boiler for providing steam to a steam turbine. The exhaust of the turbine is condensed and pumped back into the boiler, first being pre-heated by a heat exchanger in the carbide-water reactor to pre-heat the boiler makeup water (steam) and to cool the reactor. The system may limit the excess water required for the carbide-water reactor, and provides recovery of the heat given off in the generation of the acetylene for maximum system efficiency. Other, alternate embodiments are also disclosed.

17 Claims, 2 Drawing Figures

CALCIUM CARBIDE POWER SYSTEM

This is a continuation of application Ser. No. 745,179, filed Nov. 26, 1976, now abandoned.

BACKGROUND OF THE INVENTION

1. Field of the Invention

The present invention relates to the field of power systems.

2. Prior Art

The present invention is very adaptable to provide either mechanical or electrical power in both stationary and mobile systems. The preferred embodiments, however, are intended for use in mobile systems, such as in the powering of automobiles, trucks and other vehicles. As such, the prior art relating to power plants for such mobile systems and the fuels used therein will be discussed, it being understood however, that the present invention is not so limited in its application.

At the present time, a very large majority of vehicles in day-to-day operation contain internal combustion engines operating on some suitable hydrocarbon fuel. Of these, most operate on gasoline, while smaller numbers operate on diesel fuels and liquid propane. These fuels, however, are becoming increasingly expensive, are subject to supply limitations by foreign powers, and would appear to be nearly exhaustible in supply in the not too distant future. Accordingly, it would be desirable to develop other propulsion systems based on other fuels or other sources of energy more readily available and not as subject to control by foreign powers.

One type of propulsion energy which attracted considerable interest in the early days of automobiles, and is the subject of substantial study at the present time, is electricity. However, since the early efforts, the rate of advance of the energy storage (battery) technology has been disappointing, and electric powered cars operating on batteries are currently highly limited in range and in recharging rate in comparison to the range of hydrocarbon fuel vehicles and the speed with which they may be refueled. Vehicles powered with electricity, however, have the advantage that the original or primary source of energy used to charge the batteries may be substantially anything, hydro-electric plants, fossil fuel burning plants, and nuclear power generating plants being the most common. Obviously, even solar energy is a potential source of power to recharge the batteries.

Other fuels have also been considered for use in vehicles, including hydrogen and acetylene. Hydrogen has the advantage of almost unlimited supply from water, and has a high energy content on a per pound basis, though poses difficult storage problems and substantial safety hazards. In essence, the concept is to use hydrogen as an energy containing medium for burning in a vehicle, thereby creating water vapor in the exhaust. The hydrogen would be generated at some remote power plant using coal, nuclear or other sources of energy, probably by the decomposition of water at that location. Such use of hydrogen as a fuel, however, has in general not proceeded beyond the very early experimental stages.

Acetylene, as previously mentioned, has also been proposed for use as a fuel for internal combustion engines. On a per pound basis, acetylene has a high energy content (higher than gasoline) and forms an explosive mixture with air over a wide range of mixing ratios. It also may be generated relatively easy from calcium carbide, a material which in itself is relatively safe and easily handled until mixed with water. As such, the safety hazard of carrying calcium carbide in a vehicle is probably substantially less than that of carrying gasoline, liquid propane or other fuels in their combustible state.

One prior art system for utilizing acetylene as a source of fuel in a mobile system is disclosed in U.S. Pat. No. 3,664,134. In that system, calcium carbide and water are combined in a reactor to form acetylene, which is then used as a fuel for a conventional internal combustion engine. The system of that patent also features as afterburner, and a calcium hydroxide scrubber for the engine exhaust for reduction of atmospheric pollutants. This system has the advantage of being operative with a conventional internal combustion engine; however, the acetylene generator has certain inefficiencies, in that apparently a large excess of water is required in the wet process for generating acetylene in the reactor in order to keep the reactor temperatures down. More importantly, all of the heat given off in the exothermic reaction between the calcium carbide and the water is lost, as there is no way to recover this heat in any useful manner for the system disclosed.

BRIEF SUMMARY OF THE INVENTION

A calcium carbide based power system for stationary and mobile power plants. The carbide is reacted with water to create heat and acetylene, with the acetylene then being burned to heat a boiler for providing steam to a steam turbine. The exhaust of the turbine is condensed and pumped back into the boiler, first being pre-heated by a heat exchanger in the carbide-water reactor to pre-heat the boiler makeup water (steam) and to cool the reactor. The system may limit the excess water required for the carbide-water reactor, and provides recovery of the heat given off in the generation of the acetylene for maximum system efficiency. Other, alternate embodiments are also disclosed.

DETAILED DESCRIPTION OF THE INVENTION

The present invention system contemplates the use of calcium carbide and water to generate heat and acetylene for use in power plants, including mobile power plants, to provide the desired output power. This system further contemplates, unlike the prior art, the use of the heat given off in the carbide-water reaction as part of the useful heat of the system so as to improve the overall efficiency of the system and to substantially eliminate the problems of keeping the reactor cool during the generation of the acetylene. In this sense, the present invention contemplates the use of carbide as the primary fuel, rather than the acetylene as contemplated in the prior art systems. Examples of the systems of the present invention are shown in the Figures, and described in detail in the following description.

Figure 1:
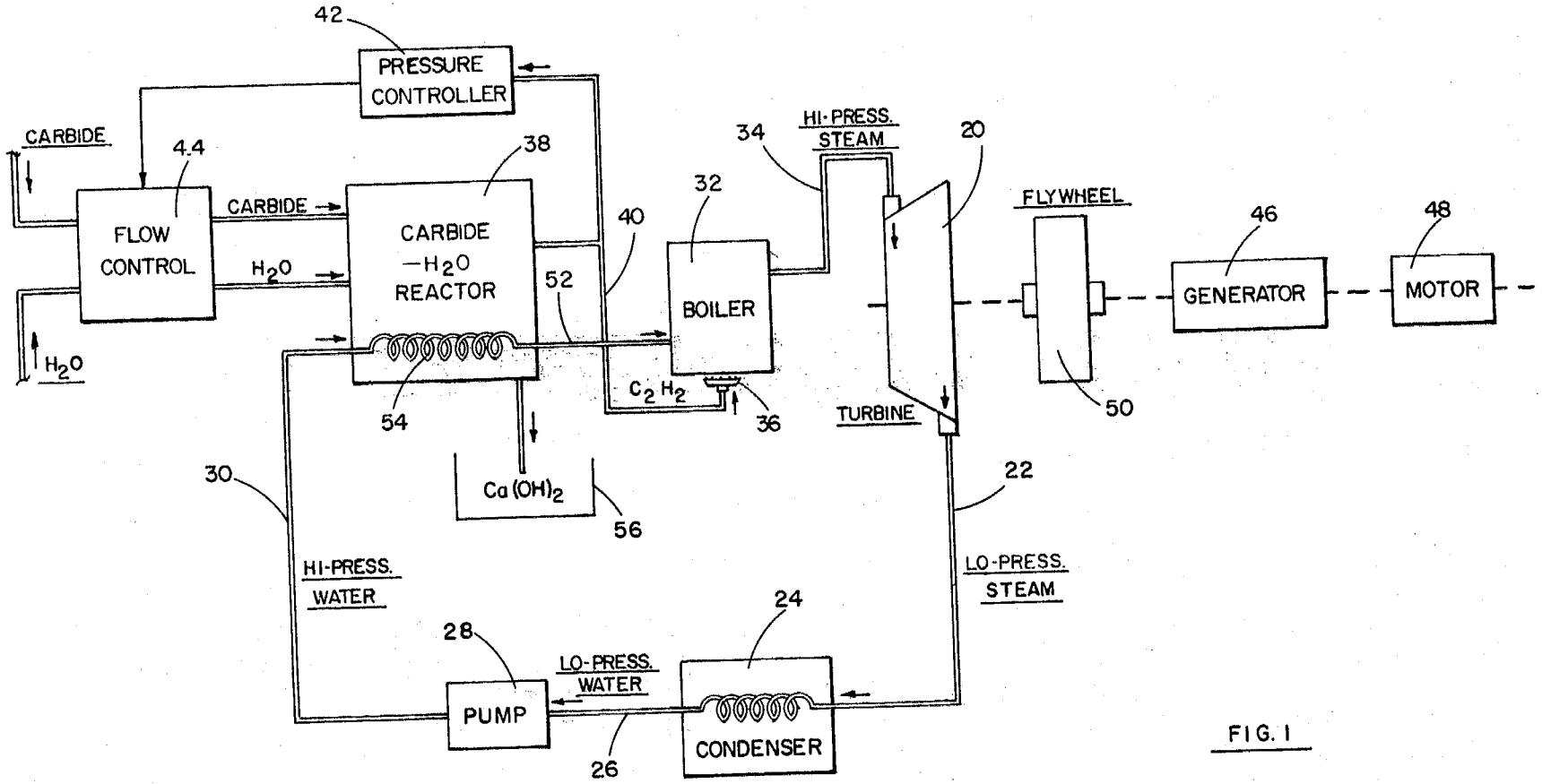
FIG. 1 is a block diagram of a power system in accordance with the present invention.

First referring to FIG. 1, a block diagram of a simple system utilizing the present invention may be seen. This system will first be described in a general overview, with further details of each of the various elements of the system being subsequently described. This embodiment utilizes a steam turbine 20, preferably operating as a closed loop system, with the outlet of the turbine 22 being directed through a condensor 24 to provide low-pressure water in line 26. Pump 28 pumps the water through line 30 back into the boiler 32 (e.g., as boiler makeup water) for conversion to steam to supply the steam turbine through line 34. These portions of the steam turbine loop are conventional and well known.

The main source of heat for the boiler 32 is acetylene ($C_2H_2$) provided to burners 36 by a carbide-water reactor 38. The acetylene is provided in line 40 on a demand or as needed basis, in this embodiment by a pressure controller 42 controlling the rate of the reaction in the carbide-water reactor through a flow control 44 controlling the rate at which the reactants are provided to the reactor.

Since turbines have a good power output and efficiency only over a limited speed range, some suitable transmission system is preferably used for a vehicle drive system, as good power outputs are required all the way down to zero speed. One method of accomplishing this is to use a generator 46 controllably driving one or more motors 48. A substantial flywheel 50 may be provided, if desired, to provide an energy storage capability for starting from a standing stop, and/or for storing energy during deceleration by reversing the roles of the generator and motor for braking.

One of the key aspects of the present invention may be seen in FIG. 1. In particular, a heat exchanger is provided in the carbide-water reactor to preheat the high pressure water line 30 prior to the return of this water (or steam) through line 52 to the boiler. This serves the dual function of cooling the reactor without requiring a great excess of water for this purpose, and recovers the heat of reaction in conversion of the carbide and water to acetylene and calcium hydroxide so as to provide maximum efficiency in the overall energy conversion from the carbide to the drive system output power. Thus the carbide reactor 38 contains heat exchanging coils 54 maintaining the reactor temperature within bounds and preheating the high pressure water returning to the boiler. Of course while the quantity of water flowing through the heat exchange coils 54 in the reactor 38 is limited, the temperature in the reactor is self-regulating, as a higher output power demand for the turbine 20 and boiler 32 will cause an increase both with respect to the gate of reaction in the reactor 38 and the water flow rate in the heat exchanger 54. Also, even at a constant power setting, increases in the reactor temperature will result in heat recovery in the heat exchange coils 54 and greater preheating of the boiler make-up water (or steam), thereby reducing the demand for acetylene and the reaction rate required to provide that acetylene.

In the previous description it is to be noted that the boiler make-up has been identified as being either water or steam. Normally in any boiler system or steam turbine system, the boiler make-up is relatively low temperature water, and in fact, in open systems, would normally be tap water at ordinary temperatures. However in the systems of the present invention, such as that shown in FIG. 1, the amount of heat recovered in the carbide-water reactor by the heat exchange coils 54 is substantial, which may convert the high pressure water in line 30 to steam in line 52. (Though normally lower in temperature than the steam in line 34 provided by the boiler 32.) The presence of water or steam in line 52 will depend upon the various parameters of the turbine system, specifically, operating pressures and temperatures, the choice of which may readily be made by anyone of reasonable skill in the art depending upon the particular application and various arbitrary design choices made. Of course, in addition to the heat and acetylene outputs of the reactor, calcium hydroxide [$Ca(OH)_2$] is also expelled from the reactor at a rate depending upon the rate of reaction, and in the system shown is collected in a container 56 for subsequent disposal, reprocessing into carbide, or for other uses, as calcium-hydroxide has other uses in both agriculture and the building industries.

It is fairly well known that acetylene is a difficult gas to store, as it exhibits a wide explosive range when mixed with air, and is subject to violent decomposition even in the pure state. Accordingly common recommendations are that it not be stored at elevated temperatures or pressurized beyond a gauge pressure of approximately 5 psi. Similarly, the wet process commonly used for generation of acetylene for carbide utilizes a great excess of water, with the heat of the carbide-water reaction being dissipated by the great quantities of excess water available. Wet process reactions typically are limited to well below the boiling temperature of water, and in fact are usually controlled to temperatures of 65° to 70° C. by feeding excess water to the generator and allowing it to overflow as an aqueous lime slurry. Obviously the use of such excesses of water in a reactor in the present invention would preclude the recovery of substantial amounts of heat from this reaction. Further, the excess water is, by the nature of the reaction, saturated with acetylene, giving rise to substantial losses of acetylene in the waste water.

In contrast to the foregoing, the present invention utilizes a carbide-water reactor which allows elevated temperatures so as to enable the recovery of the heat given off in the reaction by the heat exchanger 54. In particular, the stability of acetylene is dependent upon certain extrinsic factors which, if properly controlled, substantially diminish the probability of decomposition and explosion. Further, in the present invention system such as in the system of FIG. 1, the acetylene is generated at a rate dependent upon the demand of the boiler 32, and is burned substantially immediately after its generation. Accordingly, the amount of acetylene present at any one time is extremely limited, so that the structure of the carbide-water reactor and other portions of the acetylene system may readily be of sufficient physical integrity to confine any such decomposition without incident. In that regard the products of such decomposition are carbon and hydrogen, both being highly combustible provided care is taken to avoid the build-up of carbon deposits in the burner systems. Also, other more complicated reactions may take place, such as polymerization and hydrogenation, though in general, the tendency for any of these reactions or decomposition may be substantially reduced by appropriate choice of materials in the carbide-reactor and acetylene lines.

The carbide-water reactor may be of substantially any suitable design for the desired purpose. By way of example, a generator for the acetylene manufacture from calcium carbide by the dry process is shown in U.S. Pat. No. 2,951,748. While the apparatus therein disclosed is generally intended for larger installations, it may readily be adapted for use as a small mobile acetylene generator, and further may be modified to include the heat exchanger schematically represented by the heat exchange coils 54 to preheat the boiler inlet water and simultaneously cool the acetylene generator. Care should be taken with such a generator however, as local temperatures may rise to as high as 1,000° C. if not adequately controlled, which temperatures may lead to some of the problems hereinbefore described. Preferably the generator is operated with the injection of just enough water or steam to substantially completely react with the carbide to provide essentially all of the acetylene potentially available from the carbide. Depending upon the characteristics of the reactor, there may also be substantial moisture in the form of steam in the acetylene generated, which moisture has the desirable effect of enhancing the stability of the acetylene at the elevated temperatures of the reactor. The steam in the carbide reactor and the acetylene generated also has the disadvantage, however, of creating a useless heat load on the system. By way of example, to the extent more water is provided to the carbide reactor than necessary for the carbide water reaction, this water will be converted to steam by the elevated temperatures of the reactor, thereby tapping some of the heat otherwise available in the reactor for the transfer to the fluid in heat transfer coils 54. Further, the steam in the acetylene line also provides a heat load on the boiler combustion system, as this steam will be heated by the burning acetylene, thereby requiring some of the heat which otherwise would have been available for use in the boiler. Thus it is desirable that the carbide reactor be most efficient in assuring substantially complete reaction of the carbide with the minimum practical water or steam available. For this purpose it may be desirable to provide a carbide-water reactor having a counter flow characteristic, whereby the carbide and resulting calcium hydroxide flow through the carbide water reactor in one direction, with the water (which quickly becomes steam at the reactor temperatures) and acetylene flowing in the opposite direction. Such an arrangement provides maximum exposure of the nearly expended carbide to water adjacent the water input end (calcium hydroxide output end) of the reactor to assure the most complete reaction possible, and further provides the exposure of substantially unreacted carbide to the moist acetylene adjacent the acetylene output end of the reactor (the carbide input end) to "dry" the acetylene coming out of the reactor as much as possible by the reaction of the moisture in the acetylene with the fresh carbide entering that region.

Figure 2:
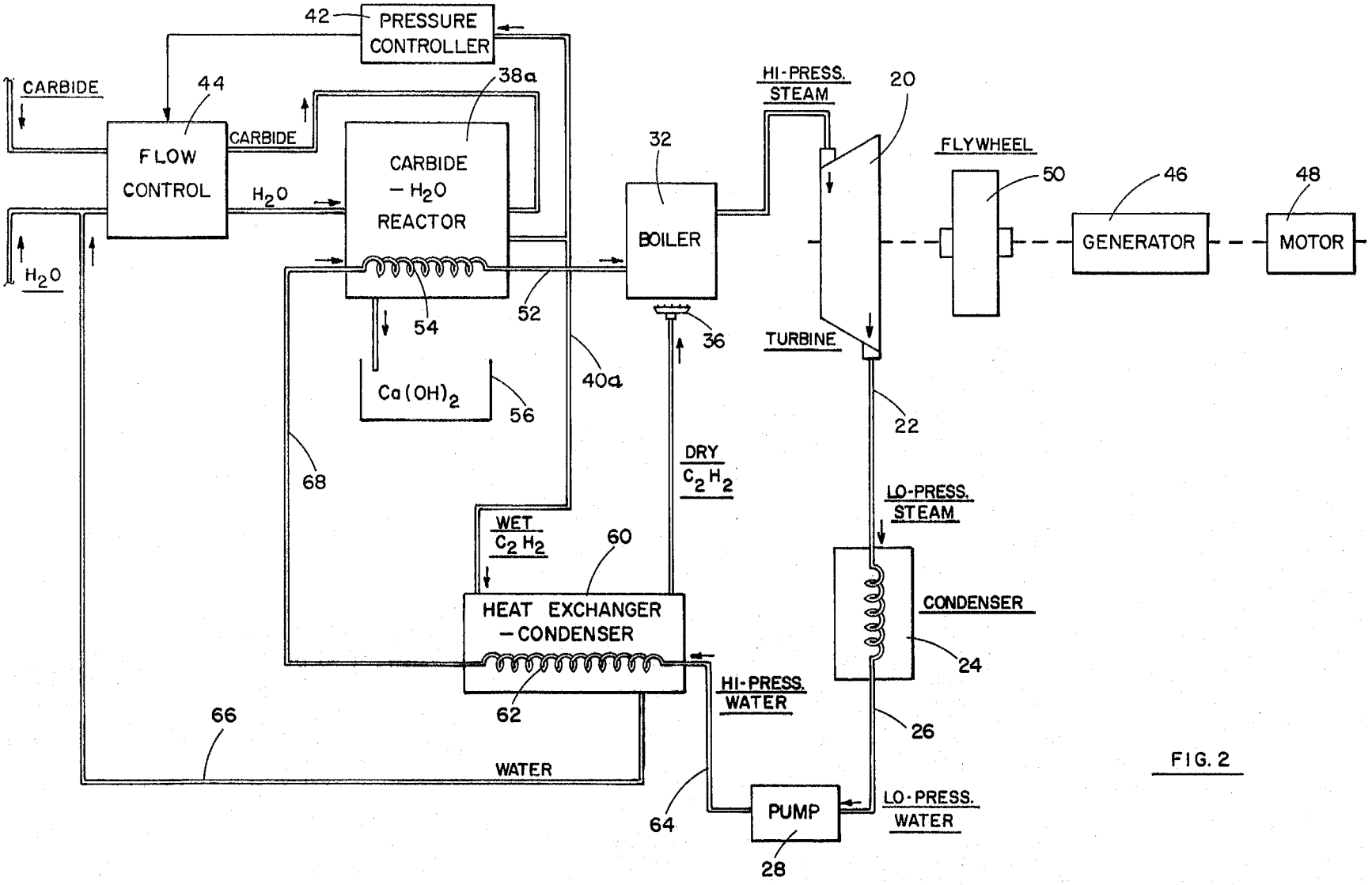
FIG. 2 is an alternate embodiment of the present invention.

Now referring to FIG. 2 an alternate embodiment of the present invention may be seen. In this embodiment the carbide reactor 38*a* is of the counterflow type just described, with the carbide and water being provided thereto by the flow control 44 in opposite directions. In addition, the acetylene output is adjacent the carbide input end to dry the acetylene as much as possible, with the calcium hydroxide output being adjacent the water input end to maximize the carbide reaction prior to the expulsion of the calcium hydroxide. In addition, in this embodiment the acetylene in line 40*a*, still having some moisture therein, is passed through a heat exchanger or condensor 60. The heat exchanger also has heat exchange coils 62 receiving high pressure water from pump 28 on line 64 so as to exchange the heat with the moist acetylene and the low temperature, high pressure water prior to the passing of the water through the heat exchange coils 54 in the carbide reactor 38*a*. Thus the acetylene is cooled so that the water will condense out, the water being returned to the input to the flow control 44 through line 66. Thus while the acetylene is cooled in the heat exchanger 60, the heat removed therefrom is returned to the system as a result of the increased temperature in the water line 68 so that no heat is lost. Further the maximum amount of moisture has been removed from the acetylene prior to its combustion in the burners 36, thereby reducing the heat load which otherwise would be placed thereon.

Two embodiments of the present invention have been disclosed and described in detail herein, exemplary of the many embodiments and various forms of implementation of the invention. While both embodiments disclose the use of a steam turbine, other devices for converting heat to mechanical or electrical energy may also be used, provided they may also effectively utilize the heat of the carbide water reaction. Thus by way of example the present invention may also be utilized with open looped steam turbine systems or other external combustion engines. Also while the embodiments disclosed utilize a dry process reactor where carbide and water are both directed to the reactor at controlled rates, alternate embodiments may control the flow of water (or steam) to carbide already in the reactor, or the flow of carbide to water (or steam) already in the reactor, utilizing either wet or dry processes. In fact, part of the turbine exhaust could be used for the reactor moisture requirement, thereby cutting down on the requirements for condensor 24 in a closed loop system, or reducing the total available water requirements in an open loop system. Further, if a wet process is used, the reactor may be pressurized as desired to sustain elevated temperatures. Thus while the present invention has been disclosed and described herein with reference to two specific embodiments, it will be understood by those skilled in the art that various changes in form and detail may be made therein without departing from the scope and spirit of the present invention.

I claim:

1. A power system comprising;

conversion means for converting a heat rate to power;

reactor means utilizing a dry process for reacting calcium carbide and water to provide acetylene and a first source of heat;

means for conveying heat from said first source of heat to said conversion means; and means coupled to said reactor means for conveying acetylene from said reactor means to said conversion means and for burning the acetylene to provide a second source of heat for said conversion means, said means for conveying heat from said first source of heat to said conversion means being a means for conveying heat at rates dependent upon the rate of the reaction in said reactor means, whereby the temperature of said reactor means will tend to be self-regulating.

2. The power system of claim 1 wherein said conversion means comprises a means for converting a heat rate to electrical power.

3. The power system of claim 1 wherein said conversion means comprises a means for converting a heat rate to mechanical power.

4. The power system of claim 1 wherein said conversion means comprises a steam turbine system.

5. The power system of claim 4 wherein said steam turbine system comprises a closed loop steam turbine system.

6. The power system of claim 1 further comprised of means for controlling the rate of the calcium carbide-water reaction in said reactor means responsive to the heat required in said conversion means.

7. The power system of claim 6 wherein said means for controlling the rate of the calcium carbide-water reaction in said reactor means comprises means for controlling the rate of addition of at least one of the reactants to said reactor.

8. The power system of claim 7 wherein said means for controlling the rate of the calcium carbide-water reaction in said reactor means comprises means for controlling the rate of addition of both calcium carbide and water to said reactor means.

9. The power system of claim 1 wherein said reactor means is a counter flow reactor means.

10. The power system of claim 1 wherein said conversion means utilizes external combustion apparatus.

11. A power system comprising:

a steam turbine means for extracting power from steam;

a boiler coupled to said steam turbine for providing steam thereto;

means for providing water to said boiler;

an acetylene burner system for heating said boiler; and a calcium carbide-water reactor coupled to said acetylene burner system for reacting calcium carbide and water utilizing a dry process to provide acetylene to said acetylene burner system;

said reactor including a heat exchanger coupled to said means for providing water to said boiler to transfer heat from said reactor to the water, the rate at which water is provided by said means for providing water to said boiler varying with the rate of the reaction in said reactor, whereby the reactor temperature will be self-regulating.

12. The power system of claim 11 wherein said means for providing water comprises a condenser coupled to the output of said steam turbine, and a pump coupled to said condensor for pumping water into said heat exchanger.

13. The power system of claim 11 further comprised of means for controlling the rate of the calcium carbide-water reaction in said reactor responsive to the need for acetylene in said acetylene burner system.

14. The power system of claim 13 wherein said means for controlling the rate of the calcium carbide-water reaction in said reactor comprises means for controlling the rate of addition of at least one of the reactants to said reactor.

15. The power system of claim 14 wherein said means for controlling the rate of the calcium carbide-water reaction in said reactor comprises means for controlling the rate of addition of both calcium carbide and water to said reactor.

16. The power system of claim 15 wherein said reactor is a counter flow reactor having an acetylene outlet adjacent the calcium carbide inlet, and a moisture inlet adjacent the outlet of the reacted calcium carbide outlet.

17. The power system of claim 11 further comprised of a condenser coupled between said reactor and said acetylene burner system for removing moisture from the acetylene produced by the reactor.

* * * * *